US007708556B2

(12) United States Patent
Splinter et al.

(10) Patent No.: US 7,708,556 B2
(45) Date of Patent: May 4, 2010

(54) BULK-MATERIAL COOLER FOR COOLING HOT MATERIAL TO BE COOLED

(75) Inventors: Christian Splinter, Pulheim (DE); Karl Schinke, Köln (DE)

(73) Assignee: KHD Humboldy Wedag GmbH, Cologne (DE)

( * ) Notice: Subject to any disclaimer, the term of this patent is extended or adjusted under 35 U.S.C. 154(b) by 48 days.

(21) Appl. No.: 11/579,809

(22) PCT Filed: May 3, 2005

(86) PCT No.: PCT/EP2005/004761

§ 371 (c)(1),
(2), (4) Date: Nov. 7, 2006

(87) PCT Pub. No.: WO2005/114080

PCT Pub. Date: Dec. 1, 2005

(65) Prior Publication Data

US 2007/0259298 A1 Nov. 8, 2007

(30) Foreign Application Priority Data

May 7, 2004 (DE) ..... 10 2004 022 754

(51) Int. Cl.
*F27D 15/02* (2006.01)

(52) U.S. Cl. ..... 432/77; 432/78; 110/281; 198/468.01; 198/773

(58) Field of Classification Search ..... 432/77, 432/78, 79, 80, 122–124; 198/773, 750.1, 198/750.2, 750.4, 584, 468.01, 765, 861.1, 198/822, 602; 110/282, 283, 291, 281
See application file for complete search history.

(56) References Cited

U.S. PATENT DOCUMENTS

| | | | | | |
|---|---|---|---|---|---|
| 1,824,756 | A | * | 9/1931 | Welser, Jr. | 198/845 |
| 2,286,332 | A | * | 6/1942 | Bleyer | 198/849 |
| 2,463,970 | A | * | 3/1949 | Hunnicutt | 198/852 |
| 3,358,385 | A | * | 12/1967 | Maberry | 432/77 |
| 3,398,942 | A | * | 8/1968 | Foeg | 34/429 |
| 3,802,553 | A | * | 4/1974 | Schrawder | 198/773 |

(Continued)

FOREIGN PATENT DOCUMENTS

EP 196 51 741 A1 6/1998

(Continued)

*Primary Examiner*—Gregory A Wilson
(74) *Attorney, Agent, or Firm*—Greer Burns & Crain Ltd

(57) ABSTRACT

The aim of the invention is to design a bulk-material cooler, particularly one for cooling cement clinker, which operates according to the walking floor principle, so that its cooling grate can be composed of a multitude of ventilated cooling grate modules, which can be assembled in an easy and variable manner, in order to obtain large lengths and widths of the cooler. When these cooling grate modules move between an advancing and returning position, even lateral and/or height offset of the guiding elements can be compensated for in a kinematic manner. To this end, the invention provides that the cooling grate, when viewed over the length and width of the cooler, is composed of a multitude of modules (13, 14) ventilated with cooling air. The coupling of the cooling grate modules of each longitudinal row of cooling grate modules is effected by an articulated joint.

20 Claims, 4 Drawing Sheets

U.S. PATENT DOCUMENTS

| | | | | |
|---|---|---|---|---|
| 3,809,212 | A * | 5/1974 | Gothe | 198/751 |
| 3,831,291 | A * | 8/1974 | Kayatz | 432/77 |
| 4,635,788 | A * | 1/1987 | McDonald | 198/848 |
| 5,213,203 | A * | 5/1993 | Kinney et al. | 198/850 |
| 5,887,703 | A * | 3/1999 | Meyer et al. | 198/773 |
| 5,895,213 | A * | 4/1999 | Sutoh et al. | 432/77 |
| 6,612,420 | B1 * | 9/2003 | Hartness et al. | 198/597 |
| 7,114,612 | B2 * | 10/2006 | Meyer et al. | 198/750.2 |
| 7,484,957 | B2 * | 2/2009 | Mersmann et al. | 432/77 |

FOREIGN PATENT DOCUMENTS

| | | |
|---|---|---|
| EP | 1021692 | 8/2001 |
| EP | 100 18 142 A1 | 10/2001 |
| WO | WO 88/07649 | 10/1988 |

* cited by examiner

BULK-MATERIAL COOLER FOR COOLING HOT MATERIAL TO BE COOLED

BACKGROUND OF THE INVENTION

The invention relates to a bulk material cooler having a cooling grate which carries the material to be cooled, such as hot cement clinker, and which conveys the material to be cooled from the material charging end to the material discharging end while a flow of cooling gas flows through said material to be cooled.

Grate coolers are used in the non-metallic minerals industry in order to drastically cool the material, such as cement clinker or other minerals, previously fired in a kiln, immediately afterwards on the cooling grate. For conveying the hot material to be cooled over the cooling line, the use of reciprocating grate coolers is particularly common, the grate system of which coolers comprises multiple alternately fixed and moving grate plate carriers, on each of which multiple grate plates are fixed, which are provided with cooling air apertures and which have a basically upward flow of cooling air passing through them. At the same time, viewed in the conveying direction, rows of fixed grate plates alternate with rows of reciprocating grate plates, which by way of their correspondingly reciprocating grate plate carriers are fixed to one or more driven reciprocating frames supported so that they can move longitudinally. The hot material to be cooled is gradually conveyed by the common oscillating movement of all moving rows of grate plates and is cooled in the process.

As an alternative to the aforementioned conventional reciprocating grate cooler, EP-1 021 692 B1 discloses a type of grate cooler in which the cooling grate with a flow of cooling air passing through it is not moved but is fixed, multiple rows of adjacent, reciprocating bar-shaped reciprocating elements being arranged above the fixed grate surface transversely to the conveying direction of the material to be cooled, said elements being moved between a forward stroke position in the material conveying direction and a return stroke position, so that the material is progressively moved from the beginning of the cooler to the end of the cooler by the reciprocating movement of these reciprocating elements in the bed of material to be cooled, cooling the material in the process. In a similar known type of grater cooler disclosed by DE 100 18 142 A1 the reciprocating elements moving above the fixed cooling grate base are divided into at least two groups and the reciprocating elements are moved forwards together in the conveying direction, but are moved backwards separately from one another rather than together.

In these known types of grate coolers the conveying capacity is decisively influenced by the difference between the volume of cement clinker moved by each forward stroke in the conveying direction and the volume of clinker undesirably moved counter to the conveying direction by the return stroke movement. In addition, in these known types of grate cooler the cross bar-shaped reciprocating elements are fixed on top of vertical drive plates oriented in the longitudinal direction of the cooler, which extend through corresponding longitudinal slots in the cooling grate and are driven from beneath the cooling grate, making it relatively expensive to seal off the cooling grate, charged with material to be cooled, to prevent material falling through the drive plate apertures, and thereby to keep the material wear within bounds. The reciprocating elements moved in the hot cement clinker bed are exposed to a high level of thermal and mechanical wear, reducing the service life of the grate cooler. Finally the hot bed of bulk material is intermixed by the reciprocating elements moved in the bed of material, which has a detrimental effect on the thermal efficiency of such types of grate cooler.

In addition, DE 196 51 741 A1 discloses a cooling tunnel for cooling and/or freezing material to be cooled by means of cold air, using a so-called "walking floor" conveying principle, in which multiple adjacent floor elements of the cooling tunnel are moved forwards together in the conveying direction but are moved back separately from one another rather than together. The intention is to form a high bulk material bed over the floor elements, which fills the entire cooling tunnel cross section, so that the cooling gas flows through the progressively advancing bulk material in the opposite direction. The actual floor elements remain uncooled by the cooling gas, so that the known cooling tunnel would be unsuited to cooling red hot cement clinker falling from the discharge end of a rotary kiln. The direct contact of the hot cement clinker with the surface of the floor elements would mean exposure to a high level of thermal and mechanical wear and in the case of hot cement clinker would therefore lead to an inadequate service life of such a cooling tunnel. Furthermore, the adjacent floor elements of such a cooler could not be used with a long length of 40 to 50 m, for example, such as industrial grate coolers need in terms of their throughput capacities and cooling line lengths for the cooling of hot cement clinker.

SUMMARY OF THE INVENTION

The object of the invention is to design a bulk material cooler operating on the "walking floor" conveying principle, especially for hot cement clinker, so that in order to achieve large cooler lengths and widths its cooling grate can be assembled from multiple easily and variably assembled ventilated cooling grate modules, in the movement of which between a forward stroke position and a return stroke position even lateral and/or vertical misalignment of the guide elements can be kinematically compensated for.

In the bulk material cooler according to the invention, the cooling grate, viewed over the length and over the width of the cooler, is assembled from multiple modules, the modules in each row arranged in series in the conveying direction of the material to be cooled being articulated to one another. At the same time, the adjacent longitudinal rows of cooling grate modules are capable of controlled movement independently of one another between a forward stroke position in the conveying direction of the material to be cooled and a return stroke position, so that the material to be cooled is progressively conveyed over the cooling grate on the walking floor conveying principle. The cooling grate thus assembled is pervious to the cooling air, which flows upwards in an approximately transverse current through the cooling grate and through the bed of bulk material deposited thereon, that is to say the load-bearing surfaces of the cooling grate modules at the same time serve as bulk material conveying and cooling grate ventilation elements. There are no reciprocating elements, which would be exposed to severe wear and which would intermix the bed of bulk material, moving in the bed of bulk material on top of the cooling grate. For example, the modules in their forward stroke movement are moved forwards together, but in their return stroke movement they are not moved together but are successively returned in at least two groups in at least two successive stages, in each of which only some of the modules are returned, for example only every second row of cooling grate modules viewed over the width of the cooler. In their return stroke movement the modules in a row are controllably returned under the resting bed of bulk material, so that the bed of bulk material remains at rest and does not participate in the return stroke movement.

However, the modules in each longitudinal row of cooling grate modules can be coupled to one another by an articulated joint like railway wagons each modular wagon then being supported on its own supporting wheels on corresponding guides.

According to one special feature of the invention each longitudinal row of cooling grate modules, with the coupled modules arranged in series in the conveying direction of the material to be cooled, is assembled from carrier modules supported on support rollers alternating with connecting modules, the latter without support rollers of their own being hitched onto the carrier modules. This means that in this embodiment two types of module are combined with one another in each longitudinal row of cooling grate modules, a feature common to all types of module being that they have on their surface a grate pervious to air, which carries the hot material to be cooled.

The coupling between the carrier modules and the connecting modules bilaterally hitched to them is in each case achieved by way of an articulated joint, in particular a ball joint or a universal joint. Owing to their articulated coupling, the hitched connecting modules are capable of compensating for lateral and/or vertical misalignment of the carrier modules. Besides the saving in terms of support rollers and spindles in the connecting modules, this also reduces the accuracy of alignment required in assembling the bulk material cooler according to the invention, thereby resulting in a comparatively low overall assembly cost. Finally, in the bulk material cooler constructed according to the invention the level of resulting, unwanted lateral guiding forces of the moving carrier modules is minimized, this level being susceptible to yet further reduction through a large center-to-center distance on the support rollers of the carrier modules.

The ease of assembly of the bulk material cooler according to the invention also stems from the fact that both the carrier modules, each together with the longitudinally traversable base frame supporting them, and also the connecting modules, each comprise a unit preassembled in the workshop, these units being easily built into the cooling grate and/or being easily built as the cooling grate at the place of installation of the grate cooler.

The support rollers, on which the base frame of the carrier modules is supported, are guided on rails. The support rollers of the carrier modules may also be so-called combination rollers, which both radially and axially are supported and guided in guide rails having a U-shaped profile, that is to say they are equipped with an axial guide on roller bearings. Instead of support rollers or combination rollers, the carrier modules may also be supported on linear roller bearings or roller guides and also on slide bearings or pendulum arms.

Viewed in the conveying direction of the material to be cooled, the coupling joints of the carrier modules for the hitched connecting modules are advantageously arranged in the area between the front and rear support rollers of the carrier modules. This means that the carrier modules cannot be induced to tilt by the load of the hitched connecting modules coupled thereto, because the support forces from the connecting modules always act between the support rollers of the carrier modules.

The carrier modules are preferably driven to perform their forward and return movements so that the moving longitudinal rows of modules and their articulated joint connections are as far as possible only subjected to tensile stress.

Owing to its low lateral guiding forces, however, the bulk material cooler according to the invention can also advantageously be used in applying compressive force to the longitudinal row of modules. A further advantage of the invention resides in the symmetrical construction of the modules. This ensures uniformity of the kinematics involved in the forward stroke and the return stroke. The lateral guiding forces are proportionally equal to the tensile and/or compressive forces. What can be said of the lateral guiding forces also applies to the vertical support forces. The relieving of the modules to a point where a bearing lifts off due to uneven vertical module loading, which would be possible in a railway wagon type of module, is precluded in a combination of carrier modules with hitched connecting modules. The force introduced into the driven modules from the approximately horizontal longitudinal feed force constitutes a further influence on the wheel loads. In order to protect the drive elements from fouling and wear, it is advisable to install the drive elements under the module conveyor tracks. The point of application of the force therefore lies significantly below the friction plane of the charged material to be cooled. This distance generates a moment, which leads to uneven loading of the axles of the module truck or carrier module. The long center-to-center distance reduces this effect. A further reduction in this effect is possible by inclining the direction in which the force is applied. This inclination in the direction of application of the force gives rise to a force component in a vertical direction, which achieves partial to complete compensation for the reduction in axle load.

BRIEF DESCRIPTION OF THE DRAWINGS

The invention and further features and advantages thereof will be explained in more detail with reference to the exemplary embodiments represented schematically in the drawings.

In the drawings.

DETAILED DESCRIPTION OF THE PREFERRED EMBODIMENTS

Figure 1:
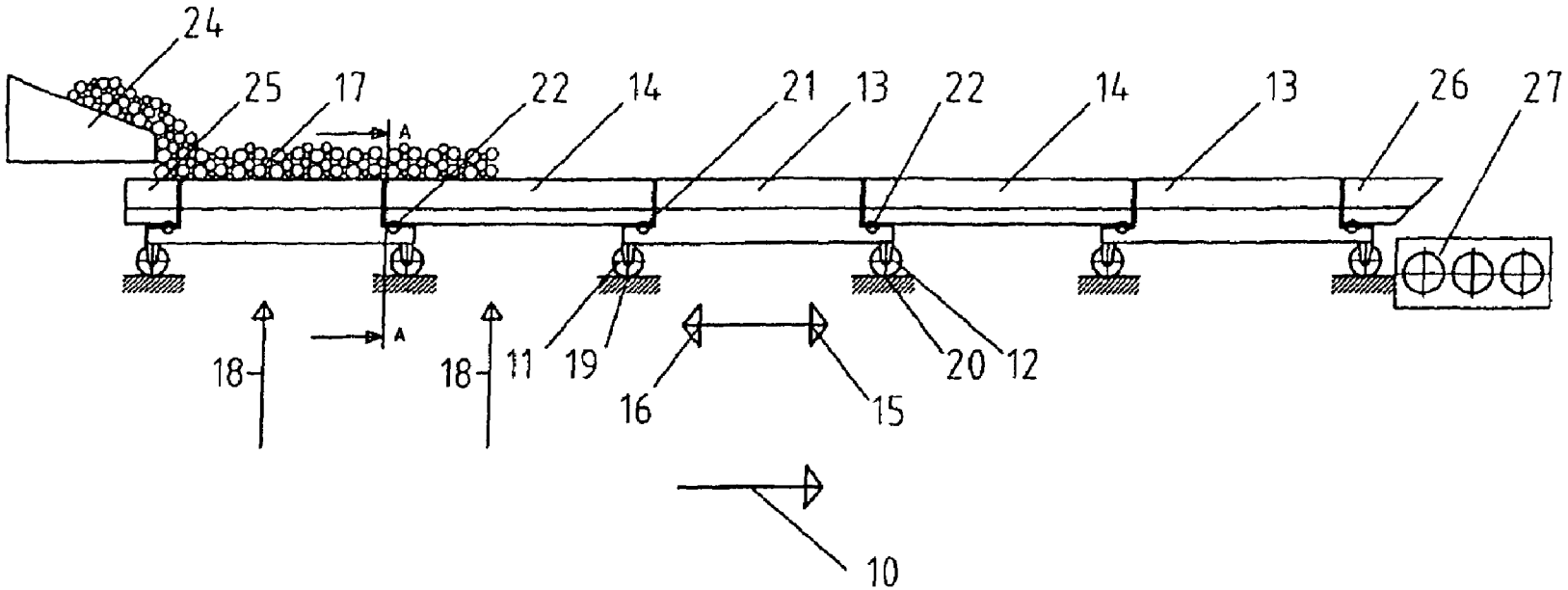
FIG. 1 shows a schematic side view of a preferred exemplary embodiment of the bulk material cooler according to the invention for cooling hot cement clinker.

The bulk material cooler according to the invention will first be explained with reference to the exemplary embodiment in FIG. 1, in which the cooling grate, viewed over the length and over the width of the cooler, is assembled from multiple modules, the modules in each row arranged in series in the conveying direction 10 of the material to be cooled being coupled together. Each longitudinal row of cooling grate modules, of which one longitudinal row can be seen in FIG. 1, is assembled from carrier modules 13 supported bilaterally on support rollers 11, 12 alternating with connecting modules 14, the latter with no support rollers of their own being hitched onto the carrier modules 13.

The rows of cooling grate modules extending over the considerable length of the bulk material cooler are capable of controlled movement independently of one another between a forward stroke position 15 in the conveying direction of the material to be cooled and a return stroke position 16, so that the material to be cooled 17, such as the hot cement clinker, is progressively conveyed over the cooling grate from the beginning of the cooler to the end of the cooler on the walking floor conveying principle. All modules are of approximately trough-shaped design and viewed in cross section have an upper side which carries the material to be cooled 17 and is upwardly pervious to the cooling air 18, and which may be provided with any perforations pervious to the cooling air 18. It is particularly advantageous if the upper sides of all modules 13, 14 each comprise saddle-roof-shaped V-profiles, which at an interval from one another are laterally inverted in opposite but staggered in relation to one another, and the V-legs of which intermesh with a gap, forming a labyrinth for the material to be cooled and for the cooling air 18. This ensures that the bulk material cooler according to the invention is safeguarded against material falling through the grate. For even more reliable avoidance of the risk of material to be cooled falling through the grate it is possible to arrange a closed bottom that prevents material falling through the grate at an interval below the grate surface of all modules 13, 14. In the latter case the cooling grate modules are ventilated in series rather than chamber-ventilated.

The support rollers 11, 12 of the carrier modules 13 are supported on guide rails 19, 20 of the substructure of the grate cooler. In a kinematic reversal, however, the undersides of the carrier modules 13 may also roll on fixed support rollers. The coupling between the carrier modules 13 and the bilaterally hitched connecting modules 14 is in each case achieved by way of an articulated joint 21, 22, preferably a ball joint or a universal joint. In assembling the bulk material cooler according to the invention the required alignment accuracy is not particularly high in the case of the guide rails 19, 20 and the support rollers 11, 12, because in the event of a lateral and/or vertical misalignment of these components the row of cooling grate modules in FIG. 1 can assume the configuration and/or the kinematics represented schematically in FIG. 2.

Figure 2:
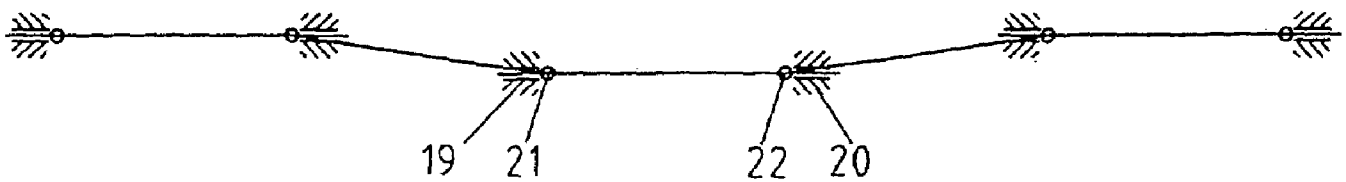
FIG. 2 shows a top view and/or side view schematically representing the kinematics of the bulk material cooler in FIG. 1 with lateral and/or vertical misalignment of the row of cooling grate modules.
Figure 3:
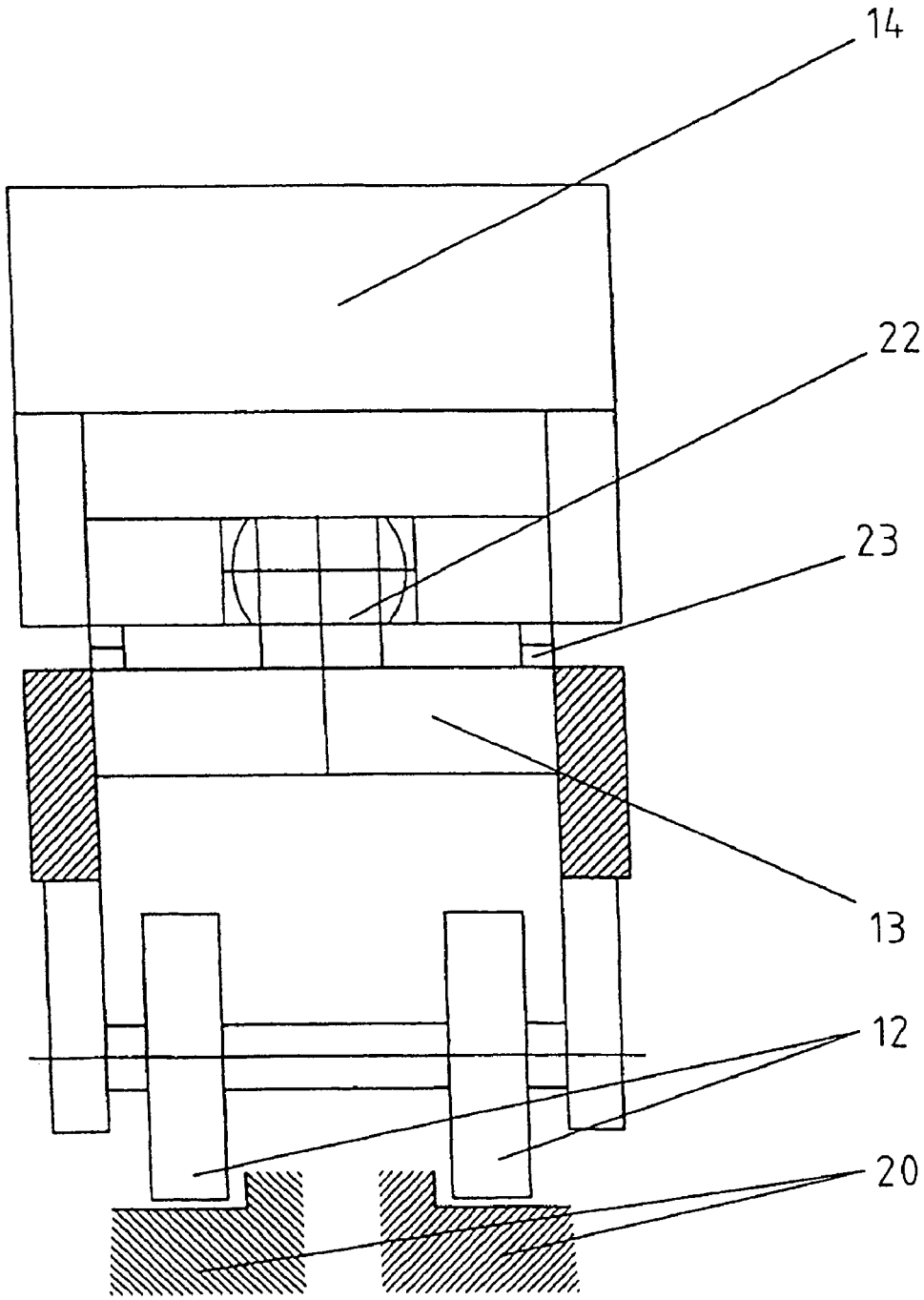
FIG. 3 shows an enlarged schematic section along the line A-A in FIG. 1 at an articulated point of the cooling grate assembled from modules, FIG. 4 and as variants of FIG. 1 show a bulk material FIG. 5 cooler having specially designed end modules at the beginning and end of the grate cooler, FIG. 6 as a further variant shows a bulk material cooler in which the carrier modules carrying the connecting modules are of especially short design and without a cooling grate of their own.

The section along the line A-A in FIG. 1 enlarged in FIG. 3 shows the base frame of a carrier module 13, which by way of four support rollers, of which the two support rollers 12 can be seen, is supported on the guide rails 20 and 19 respectively. On their upper side the carrier modules 13 on either side have a universal joint 22 and 21, by means of which the connecting module 14 is hitched onto the carrier module. At the same time lateral guides 23 in the articulated joint plane prevent any transverse inclination of the hitched connecting modules 14. That is to say the lateral guides 23 are designed so that only that degree of freedom which would permit lateral tilting of the modules is precluded. This can be achieved, for example, by a domed shape of the guides and a surface having a low coefficient of friction. These guides further serve to support the weight of the hitched modules. These two functions make the construction statically determinate.

Both the carrier modules 13, each together with the longitudinally traversable base frame supporting them, and also the connecting modules 14, may each comprise a unit preassembled in the workshop, these units being easily built into the cooling grate and/or being easily as the cooling grate at the place of installation of the grate cooler with comparatively little assembly effort.

Figure 7:
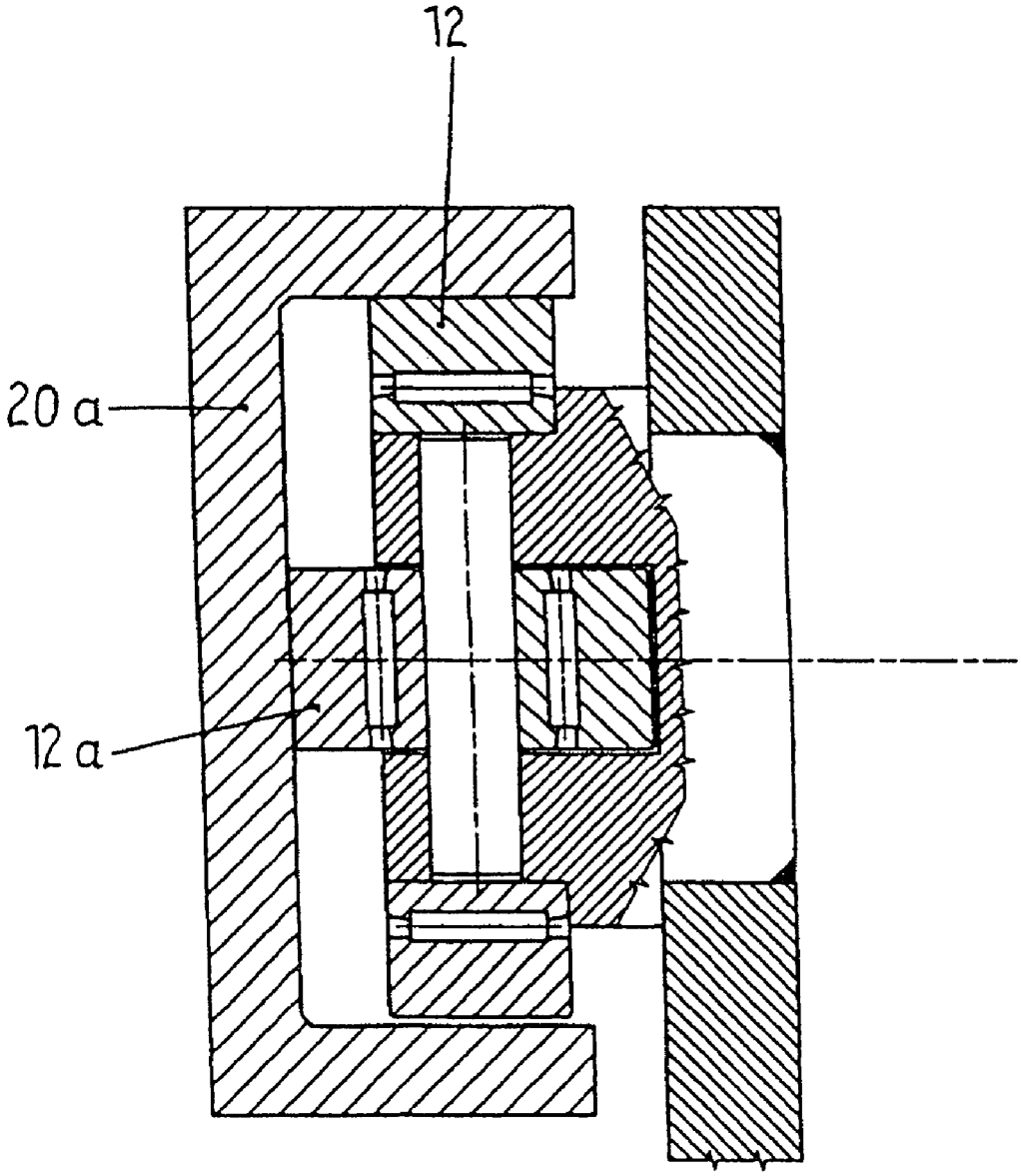
FIG. 7 shows an enlarged detail of a combination roller for supporting and guiding the carrier modules of the cooling grate.

Instead of the support rollers 12 shown in FIG. 3, combination rollers may also be used, which radially and axially are supported and guided in U-profile guide rails tilted by 90° in comparison to FIG. 3, that is to say in the spindle area the combination rollers have their own rolling elements for axial guiding of the rollers. FIG. 7 shows an enlarged detail of such a combination roller, the support roller 12 of which runs in the U-profile 20*a* for radial support and the rolling element 12*a* of which runs in said profile at the axial end for axial support.

Viewed in the conveying direction of the material to be cooled, the coupling joints 21, 22 of the carrier modules 13 for the hitched connecting modules 14 are each arranged in the area between the front and the rear support rollers 11 and 12 of the carrier modules 13, so that the support forces from the connecting modules 14 always act between the support rollers of the carrier modules 13.

The forward and return movement of each of the adjacent rows of cooling grate modules can be imparted from beneath the cooling grate by working cylinders, which suitably act on one or more of the carrier modules 13. Over the width of the grate cooler, for each cooling grate module multiple adjacent elongate cooling grate tracks can be combined to form the preassembled unit, the individual cooling grate tracks of which are moveable independently of one another between the forward stroke position and the return stroke position.

It can also be seen from FIG. 1 that as it falls from the end of a rotary kiln the hot cement clinker 17 to be cooled is first transferred by a static, non-moving preliminary grate 24 onto a reciprocating end piece 25, which by means of an articulated joint is hitched to the front side of the first carrier module 13. An end module 26, by way of which the cooled cement clinker is delivered to a roll crusher 27, may be coupled to the last carrier module 13.

Figure 4:
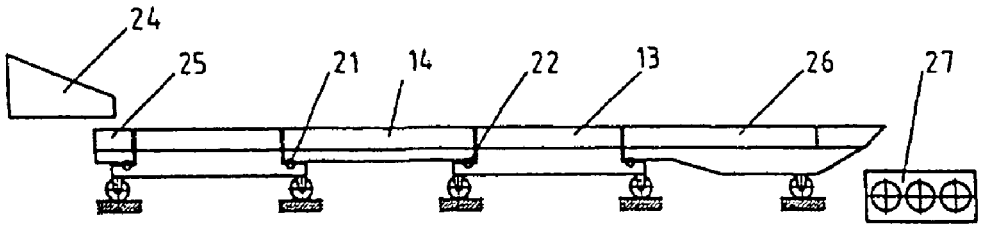
Figure 5:
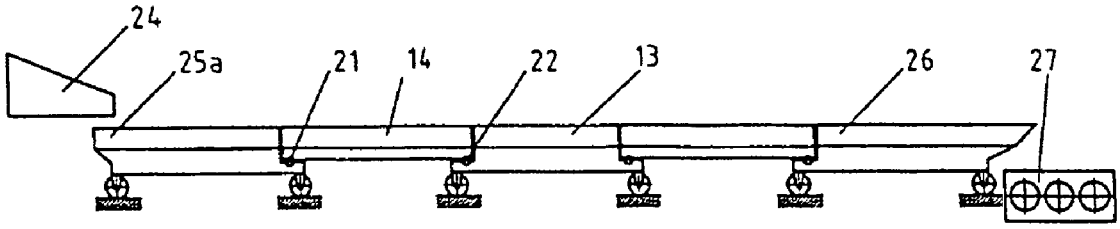

In the exemplary embodiment in FIG. 4 the row of cooling grate modules has an extended unilaterally hitched end module 26. In the exemplary embodiment in FIG. 5 the first end module 25*a* is not hitched but like a carrier module is supported by way of support rollers on a guide.

Figure 6:
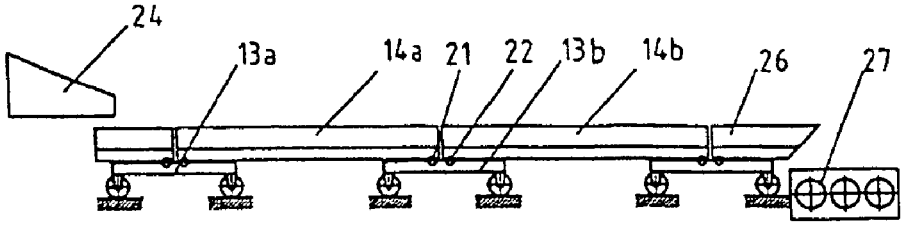

In the exemplary embodiment in FIG. 6 the carrier modules 13*a*, 13*b* etc. are of comparatively short design without their own cooling grate. The articulated joints 21, 22 of these carrier elements lie comparatively close together. The connecting modules 14*a*, 14*b* hitched onto the carrier elements 13*a*, 13*b* etc. adjoin one another virtually directly, that is to say in plan view the cooling grate of the grate cooler in FIG. 6 only comprises the connecting modules 14*a*, 14*b* etc. carrying the material to be cooled 17.

The variants represented in FIGS. 1, 4, 5 and 6 are capable of any combination with one another.

The upper sides of all modules carrying the material to be cooled 17 are of approximately trough-shaped design, so that they retain the bottom layer of bulk material in order to prevent any relative movement between this bottom layer of material and the respective module upper surface, which helps inherently to protect all cooling grate modules 13, 14 against wear.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A bulk material cooler having a cooling grate which carries material to be cooled, and which conveys the material to be cooled in a conveying direction from a material charging end to a material discharging end while a flow of cooling gas flows through the material to be cooled, comprising:

a) the cooling grate, viewed over a length and over a width of the cooler, is assembled from multiple cooling grate modules arranged in a plurality of longitudinal rows, the modules in each row arranged in series in the conveying direction of the material to be cooled, being coupled to one another;

b) the coupling of the cooling grate module in each longitudinal row of cooling grate modules is in each case achieved by an articulated joint;

c) at least some of the cooling grate modules are supported by support rollers on guides;

d) adjacent longitudinal rows of cooling grate modules are controlled for reciprocating movement such that all of the longitudinal rows move forwards together in a forward stroke in the conveying direction of the material to be cooled and are returned in at least two successive stages by means of a return stroke movement of fewer than all of the longitudinal rows at one time, so that the material to be cooled is progressively conveyed over the cooling grate according to the walking floor principle.

2. The bulk material cooler as claimed in claim 1, wherein each longitudinal row of cooling grate modules is assembled from carrier modules supported on support rollers alternating with connecting modules, the latter, without support rollers of their own, being hitched onto the carrier modules.

3. The bulk material cooler as claimed in claim 2, wherein both the carrier modules, each together with a longitudinally traversable base frame supporting them, and also the connecting modules, each comprise a preassembled unit, these units being easily built into the cooling grate or being easily built as the cooling grate at the place of installation of the grate cooler.

4. The bulk material cooler as claimed in claim 3, wherein the support rollers, on which the base frame of the carrier modules is supported, are guided on rails.

5. The bulk material cooler as claimed in claim 2, wherein the articulated joints between the carrier modules and the hitched connecting modules are universal joints.

6. The bulk material cooler as claimed in claim 2, wherein the carrier modules are driven to perform their forward and return stroke movements so that the moving longitudinal rows of modules and their articulated joint connections are subjected only to tensile stress.

7. The bulk material cooler as claimed in claim 2, wherein the articulated joints between the carrier modules and the hitched connecting modules are ball joints.

8. The bulk material cooler as claimed in claim 1, wherein the support rollers are combination rollers, which are radially and axially supported and guided in guide rails having a U-profile.

9. A bulk material cooler having a cooling grate which carries material to be cooled, and which conveys the material to be cooled in a conveying direction from a material charging end to a material discharging end while a flow of cooling gas flows though the material to be cooled, comprising:

a) the cooling grate, viewed over a length and over a width of the cooler, is assembled from multiple cooling grate modules arranged in a plurality of longitudinal rows, the modules in each row arranged in series in the conveying direction of the material to be cooled, being coupled to one another;

b) the coupling of the cooling grate modules in each longitudinal row of cooling grate modules is in each case achieved by an articulated joint;

c) at least some of the cooling grate modules are supported by support rollers on guides;

d) adjacent longitudinal rows of cooling grate modules are controlled for movement independently of one another between a forward stoke position in the conveying direction of the material to be cooled and a return stroke position, so that the material to be cooled is progressively conveyed over the cooling grate, wherein each longitudinal row of cooling grate modules is assembled from carrier modules supported on support rollers alternating with connecting modules, the latter, without support rollers of their own, being hitched onto the carrier modules and wherein the coupling joints of the carrier modules for the hitched connecting modules are each arranged in an area between front and rear support rollers of the carrier modules.

10. The bulk material cooler having a cooling grate which carries material to be cooled, and which conveys the material to be cooled in a conveying direction from a material charging end to a material discharging end while a flow of cooling gas flows through the material to be cooled, comprising:

a) the cooling grate, viewed over a length and over a width of the cooler, is assembled from multiple cooling grate modules arranged in a plurality of longitudinal rows, the modules in each row arranged in series in the conveying direction of the material to be cooled, being coupled to one another;

b) the coupling of the cooling grate modules in each longitudinal row of cooling grate modules is in each case achieved by an articulated joint;

c) at least some of the cooling grate modules are supported by support rollers on guides;

d) adjacent longitudinal rows of cooling grate modules are controlled for movement independently of one another between a forward stroke position in the conveying direction of the material to be cooled and a return stoke position, so that the material to be cooled is progressively conveyed over the cooling grate, wherein, each longitudinal row of cooling grate modules is assembled from carrier modules supported on support rollers alternating with connecting modules, the latter, without support rollers of their own, being hitched onto the carrier modules and wherein both the carrier modules, each together with a longitudinally traversable base frame supporting them, and also the connecting modules, each comprise a preassembled unit, these units being easily built into the cooling grate or being easily built as the cooling grate at the place of installation of the grate cooler, and wherein when viewed over the width of the cooler, for each cooling grate module, multiple adjacent elongate cooling grate tracks are assembled to form the preassembled unit, the individual cooling grate tracks of which are moveable independently of one another between the forward stroke position and the return stroke position.

11. A bulk material cooler having a cooling grate which carries material to be cooled, and which conveys the material to be cooled in a conveying direction from a material charging end to a material discharging end while a flow of cooling gas flows through the material, comprising:

multiple cooling grate modules forming the cooling grate arranged in a plurality of longitudinal rows, the modules in each row being coupled to one another in series in the conveying direction by articulated joints;

support rollers supporting at least some of the cooling grate modules; and drive mechanisms arranged to reciprocatingly move adjacent longitudinal rows of cooling grate modules such that all of the longitudinal rows move forwards together in a forward stroke in the conveying direction and such that all of the longitudinal rows do not return simultaneously by a return stroke movement, so that the material is progressively conveyed over the cooling grate according to the walking floor principle.

12. The bulk material cooler as claimed in claim 11, wherein each longitudinal row of cooling grate modules is assembled from carrier modules supported on support rollers alternating with connecting modules, the latter, without support rollers of their own, being hitched onto the carrier modules.

13. The bulk material cooler as claimed in claim 12, wherein each of the carrier modules, together with a longitudinally traversable base frame supporting them, and also the connecting modules, comprise a preassembled unit.

14. The bulk material cooler as claimed in claim 13, wherein the support rollers, on which the base frame of the carrier modules is supported, are guided on rails.

15. The bulk material cooler as claimed in claim 12, wherein the articulated joints between the carrier modules and the hitched connecting modules are universal joints.

16. The bulk material cooler as claimed in claim 12, wherein the carrier modules are driven by the drive mechanisms to perform their forward and return stroke movements so that the moving longitudinal rows of modules and their articulated joint connections are subjected only to tensile stress.

17. The bulk material cooler in claim 12, wherein the articulated joints between the carrier modules and the hitched connecting modules are ball joints.

18. The bulk material cooler as claimed in claim 11, wherein the support rollers are combination rollers, which are radially and axially supported and guided in guide rails having a U-profile.

19. A bulk material cooler having a cooling grate which carries material to be cooled, and which conveys the material to be cooled in a conveying direction from a material charging end to a material discharging end while a flow of cooling gas flows through the material, comprising:

multiple cooling grate modules forming the cooling grate arranged in a plurality of longitudinal rows, the modules in each row being coupled to one another in series in the conveying direction by articulated joints;

support rollers supporting at least some of the cooling grate modules;

each longitudinal row of cooling grate modules is assembled from carrier modules supported on support rollers alternating with connecting modules, the latter without support rollers of their own, being hitched onto the carrier modules; and drive mechanisms arranged to move adjacent longitudinal rows of cooling grate modules independently of one another between a forward stroke position in the conveying direction and a return stroke position, so that the material is progressively conveyed over the cooling grate, wherein the coupling joints of the carrier modules for the hitched connecting modules are each arranged in an area between front and rear support rollers of the carrier modules.

20. The bulk material cooler having a cooling grate which carries material to be cooled, and which conveys the material to be cooled in a conveying direction from a material charging end to a material discharging end while a flow of cooling gas flows through the material, comprising:

multiple cooling grate modules forming the cooling grate arranged in a plurality of longitudinal rows, the modules in each row being coupled to one another in series in the conveying direction by articulated joints;

support rollers supporting at least some of the cooling rate modules;

each longitudinal row of cooling grate modules is assembled from carrier modules supported on support rollers alternating with connecting modules, the latter without support rollers of their own, being hitched onto the carrier modules; and drive mechanisms arranged to move adjacent longitudinal rows of cooling grate modules independently of one another between a forward stroke position in the conveying direction and a return stroke position, so that the material is progressively conveyed over the cooling grate and wherein each of the carrier modules, together with a longitudinally traversable base frame supporting them, and also the connecting modules, comprise a preassembled unit, and wherein, when viewed over the width of the cooler, for each cooling grate module, multiple adjacent elongate cooling grate tracks are assembled to form the preassembled unit, the individual cooling grate tracks of which are moveable independently of one another between the forward stroke position and the return stroke position.

* * * * *